US007336034B2

(12) United States Patent
Kwon et al.

(10) Patent No.: US 7,336,034 B2
(45) Date of Patent: Feb. 26, 2008

(54) STRUCTURE FOR CONNECTING TERMINAL PARTS OF ELECTRODES OF PLASMA DISPLAY PANEL AND PLASMA DISPLAY PANEL HAVING THE SAME

(75) Inventors: Jae-Ik Kwon, Suwon-si (KR); Kyoung-Doo Kang, Suwon-si (KR); Won-Ju Yi, Suwon-si (KR); Seok-Gyun Woo, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 52 days.

(21) Appl. No.: 11/423,780

(22) Filed: Jun. 13, 2006

(65) Prior Publication Data

US 2006/0284558 A1 Dec. 21, 2006

(30) Foreign Application Priority Data

Jun. 16, 2005 (KR) ..... 10-2005-0052020

(51) Int. Cl.
*H01J 17/49* (2006.01)

(52) U.S. Cl. ..... 313/583; 313/584; 313/585

(58) Field of Classification Search ..... 313/583–585
See application file for complete search history.

(56) References Cited

U.S. PATENT DOCUMENTS 5,977,708 A * 11/1999 Amatsu et al. ..... 313/586
6,414,435 B1 * 7/2002 Akiba ..... 313/584
7,230,381 B2 * 6/2007 Ohkubo et al. ..... 313/583

FOREIGN PATENT DOCUMENTS

JP 2000223035 A * 8/2000
JP 2003208850 A * 7/2003
JP 2004093860 A * 3/2004

* cited by examiner

*Primary Examiner*—Nimeshkumar D. Patel
*Assistant Examiner*—Peter Macchiarolo
(74) *Attorney, Agent, or Firm*—H.C. Park & Associates, PLC

(57) ABSTRACT

A structure for connecting terminal parts of electrodes of a plasma display panel (PDP) includes a pair of substrates, barrier ribs arranged between the pair of substrates, a dielectric layer arranged between the pair of substrates, discharge electrodes, each having a discharge part arranged inside the barrier ribs, and an exposed part arranged at an end of the discharge part and outside the barrier ribs, terminal electrodes arranged on the dielectric layer, connection parts including conductive paste electrically connecting the exposed parts with the terminal electrodes, blocking partition walls arranged between the connection parts, and signal transmitting members electrically connected with the terminal electrodes.

36 Claims, 5 Drawing Sheets

STRUCTURE FOR CONNECTING TERMINAL PARTS OF ELECTRODES OF PLASMA DISPLAY PANEL AND PLASMA DISPLAY PANEL HAVING THE SAME

CROSS-REFERENCE TO RELATED APPLICATION

This application claims priority to and the benefit of Korean Patent Application No. 10-2005-0052020, filed on Jun. 16, 2005, which is hereby incorporated by reference for all purposes as if fully set forth herein.

BACKGROUND OF THE INVENTION

1. Field of the Invention

The present invention relates to a structure for connecting terminal parts of electrodes of a plasma display panel (PDP), and a PDP having the same, and more particularly, to a structure for connecting terminal parts of electrodes of a PDP, by which discharge electrodes and terminal electrodes may be reliably connected with each other, and a PDP having the same.

2. Discussion of the Background

Plasma display panels (PDPs) are widely considered to be the best replacement for conventional cathode ray tube (CRT) display devices. Generally, a plasma display device contains a discharge gas sealed between two substrates having a plurality of electrodes, and applying a voltage to the electrodes generates a discharge that excites a phosphor material to generate light.

A drive circuit substrate applies voltages corresponding to an image signal to drive a PDP. Also, exposed edges of the discharge electrodes are typically connected to terminal electrodes, which are connected to the drive circuit substrate via signal transmitting members.

For a conventional opposing discharge PDP in which discharge electrodes are located inside barrier ribs, a height difference may exist between the discharge electrodes, which are located inside the barrier ribs, and the terminal electrodes, which are formed on a substrate.

Thus, when electrically connecting the ends of the discharge electrodes and the terminal electrodes to each other, the ends of the discharge electrodes may be damaged, or the discharge electrodes may be shorted together. Accordingly, it is necessary to develop a structure for connecting terminal parts of electrodes, by which discharge electrodes and terminal electrodes may be reliably and efficiently connected with each other.

SUMMARY OF THE INVENTION

The present invention provides a structure for connecting terminal parts of electrodes of a plasma display panel (PDP), by which discharge electrodes and terminal electrodes may be more reliably and efficiently connected with each other using connection parts made of conductive paste and blocking partition walls, and a PDP having the same.

Additional features of the invention will be set forth in the description which follows, and in part will be apparent from the description, or may be learned by practice of the invention.

The present invention discloses a structure for connecting terminal parts of electrodes of a PDP. The structure includes a pair of substrates facing each other, barrier ribs located between the pair of substrates and defining discharge cells together with the pair of substrates, a dielectric layer formed between the pair of substrates, and discharge electrodes. Each discharge electrode includes a discharge part located inside the barrier ribs and performing discharge, and an exposed part connected to the discharge part and located outside the barrier ribs. Terminal electrodes are located on the dielectric layer, and connection parts made of conductive paste electrically connect the exposed parts with the terminal electrodes. Blocking partition walls electrically insulate neighboring connection parts from each other, and signal transmitting members are electrically connected with the terminal electrodes.

The present invention also discloses another structure for connecting terminal parts of electrodes of a plasma display panel. The structure includes a pair of substrates facing each other, barrier ribs located between the pair of substrates and defining discharge cells together with the pair of substrates, and discharge electrodes. Each discharge electrode includes a discharge part located inside the barrier ribs and performing discharge, and an exposed part located outside the barrier ribs. Terminal electrodes are located on one of the pair of substrates, and connection parts made of conductive paste electrically connect the exposed parts to the terminal electrodes. Blocking partition walls electrically insulate neighboring connection parts from each other, and signal transmitting members are electrically connected with the terminal electrodes.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
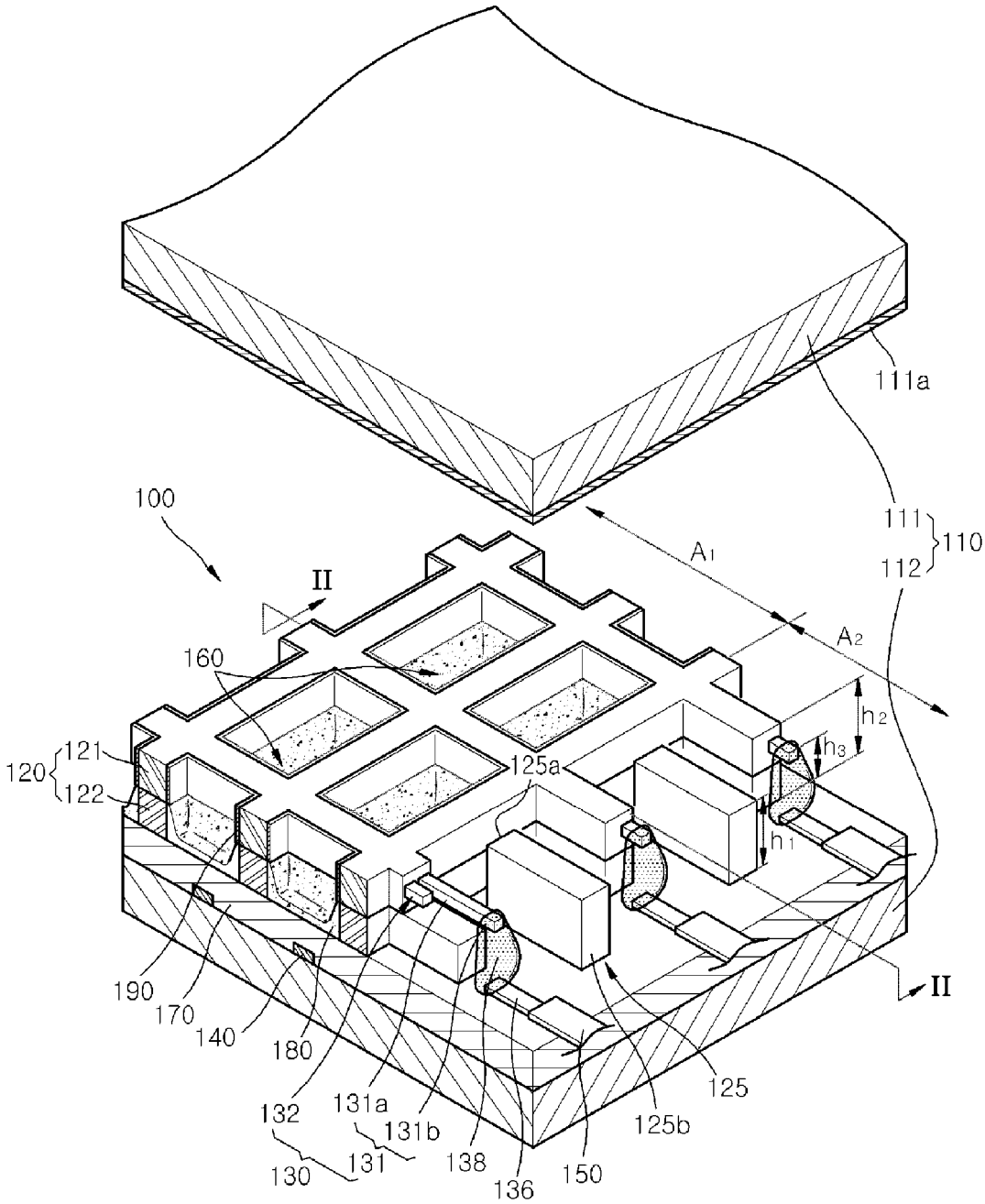
FIG. 1 is an exploded perspective view of part of a PDP including a structure for connecting terminal parts of electrodes according to a first exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element such as a layer, film, region or substrate is referred to as being "on" another element, it can be directly on the other element or intervening elements may also be present. In contrast, when an element is referred to as being "directly on" another element, there are no intervening elements present.

Figure 2:
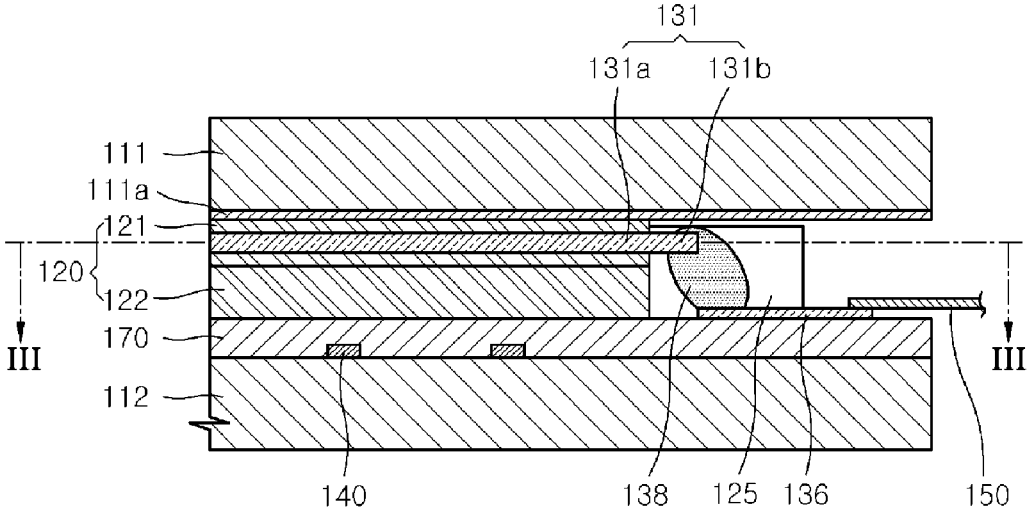
FIG. 2 is a cross-sectional view through section II-II of FIG. 1.
Figure 3:
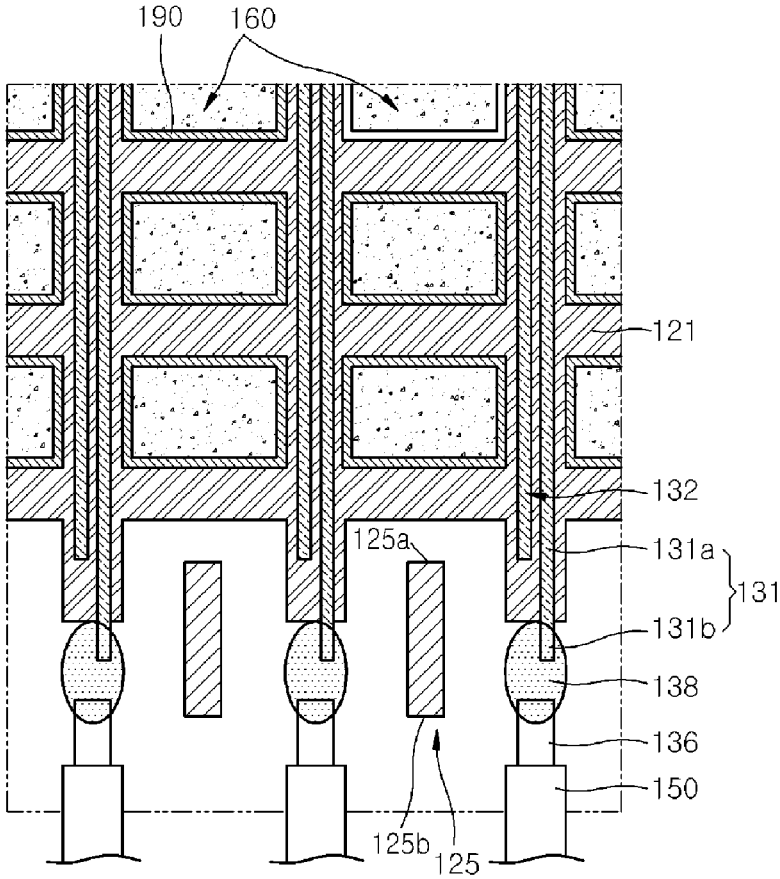
FIG. 3 is a cross-sectional view through section III-III of FIG. 2.

FIG. 1 is an exploded perspective view of part of a PDP 100 including a structure for connecting terminal parts of electrodes according to a first exemplary embodiment of the present invention, FIG. 2 is a cross-sectional view through section II-II of FIG. 1, and FIG. 3 is a cross-sectional view through section III-III of FIG. 2.

As shown in FIG. 1, FIG. 2, and FIG. 3, the PDP 100 includes a pair of substrates 110, barrier ribs 120, sustain electrode pairs 130, address electrodes 140, and signal transmitting members 150.

The pair of substrates 110 includes a first substrate 111 and a second substrate 112 facing each other and separated by a predetermined gap. The first substrate 111 may be made of a transparent material such as glass to allow visible rays to pass through it.

The first substrate 111 includes a substrate protection layer 111*a* on its rear surface. The substrate protection layer 111*a* may be made of a material such as MgO, which prevents plasma particle sputtering from damaging the first substrate 111 and lowers a discharge voltage by emitting secondary electrons.

While the first substrate 111 is shown with the substrate protection layer 111*a* on its rear surface, the substrate protection layer 111*a* may be omitted.

Furthermore, while the first embodiment has a structure in which visible rays generated by phosphor layers 180 are emitted through the first substrate 111, visible rays may be emitted through the second substrate 112 by forming the second substrate 112 of a transparent material such as glass.

The barrier ribs 120 include a first barrier rib 121 and a second barrier rib 122.

The first barrier rib 121 and the second barrier rib 122 define a plurality of discharge cells 160 together with the first substrate 111 and the second substrate 112.

While the barrier ribs 120 are shown divided into the first barrier ribs 121 and the second barrier ribs 122, the barrier ribs 120 may be one body.

Since the first substrate 111 and the second substrate 112 are longer than the barrier ribs 120, they may sufficiently define the discharge cells 160 together with the barrier ribs 120 and still allow the signal transmitting members 150 to be easily located in areas between them without the barrier ribs 120.

While the horizontal section of each discharge cell 160 is shown with a rectangular shape, the horizontal section of each discharge cell 160 may have various shapes such as a polygon, a triangle, a pentagon, a circle, and an oval.

The first barrier ribs 121, which are located between the first substrate 111 and the second substrate 112, are made of a dielectric substance. The sustain electrode pairs 130 are located inside the first barrier ribs 121, which extend from the first substrate 111.

The dielectric substance of the first barrier ribs 121 may prevent charged particles from colliding with and damaging the sustain electrode pairs 130, and it accumulates wall charges by inducing charged particles. PbO, $B_2O_3$, or $SiO_2$ may be used for the dielectric substance.

As noted above, while the first barrier ribs 121 in the first embodiment are formed as extensions of the first substrate 111, the first barrier ribs 121 may alternatively be extensions of the second substrate 112, or they may be formed by inserting the sustain electrode pairs 130 in a dielectric substance, forming the dielectric substance into a sheet, forming holes corresponding to the discharge spaces in the sheet, and placing the sheet on the second barrier ribs 122.

Each sustain electrode pair 130 includes a common electrode 131 and a scan electrode 132 as discharge electrodes.

The second barrier ribs 122 are made of a dielectric substance, located between the first substrate 111 and the second substrate 112, and attached to the first barrier ribs 121.

Since the sustain electrode pairs 130 are located inside the first barrier ribs 121 of the PDP 100, the common electrodes 131 and the scan electrodes 132 of the sustain electrode pairs 130 do not have to be transparent. Rather, they may be formed of a metallic material having excellent conductivity and low resistance, such as Ag, Al, or Cu. This increases discharge response speed, prevents signal distortion, and reduces power consumption.

While the common electrodes 131 and the scan electrodes 132 are shown having a linear shape, the common electrodes 131 and the scan electrodes 132 may be formed to surround the discharge cells 160. In this case, they may have a shape such as a ladder shape, a ring shape, and a rectangular loop shape. With such configurations, since sustain discharge may occur perpendicular to all sides of the discharge cells 160, the discharge area is widened, and a lower driving voltage is possible, thereby increasing light emission efficiency.

Striped address electrodes 140 are arranged substantially perpendicular to the common electrodes 131 and the scan electrodes 132 on the front surface of the second substrate 112. The address electrodes 140 select discharge cells 160 in which discharge occurs by performing address discharge together with the scan electrodes 132.

Since the linear shaped common electrodes 131 and scan electrodes 132 extend in the same direction, the address electrodes 140 are included to perform the address discharge for selecting discharge cells 160 in which discharge occurs. However, if discharge parts of the common electrodes 131 and scan electrodes 132 of the PDP 100 are formed to surround the discharge cells 160, an addressing role can be simultaneously performed by arranging the common electrodes 131 and the scan electrodes 132 to cross each other, thereby eliminating the need for separate address electrodes 140.

A dielectric layer 170 covers the address electrodes 140 and is made of a dielectric substance, which may prevent cations or electrons from colliding with and damaging the address electrodes 140 and may induce electric charges. PbO, $B_2O_3$, or $SiO_2$ may be used for the dielectric substance.

The phosphor layers 180 are formed to cover the lower surfaces of the discharge cells 160 and the sides of the second barrier ribs 122. However, the phosphor layers 180 may be located on the upper surfaces of the discharge cells 160 or at various other positions.

The phosphor layers 180 generate visible rays after receiving ultraviolet rays. A red phosphor layer formed in a red light emission discharge cell may include a fluorescent substance such as $Y(V,P)O_4$:Eu; a green phosphor layer formed in a green light emission discharge cell may include a fluorescent substance such as $Zn2SiO_4$:Mn; and a blue phosphor layer formed in a blue light emission discharge cell may include a fluorescent substance such as BAM:Eu.

Barrier rib protection layers 190 are formed on the sides of the first barrier ribs 121.

The barrier rib protection layers 190 may be made of a material such as MgO, thereby preventing plasma particle sputtering from damaging the first barrier ribs 121 and lowering the discharge voltage by emitting secondary electrons.

Discharge gas, such as Ne, Xe, or Ne/Xe-mixed gas, is sealed in the discharge cells 160 defined by the first substrate 111, the second substrate 112, and the barrier ribs 120.

As described above, each sustain electrode pair 130, which are discharge electrodes, includes the common electrode 131 and the scan electrode 132.

Since the common electrode 131 and the scan electrode 132 may be symmetrically formed to be easily connected to driving circuit boards (not shown) using the corresponding signal transmitting member 150, and they share the same structure, a structure for connecting terminal parts of electrodes will be described below using the common electrode 131 as an example.

Each common electrode 131 includes a discharge part 131*a* and an exposed part 131*b*.

The discharge part 131*a* is located inside the first barrier rib 121 to perform discharge, and the exposed part 131*b* is located at the end of the discharge part 131*a*, outside the first barrier rib 121.

Each terminal electrode 136 is formed on the dielectric layer 170, and each connection part 138 is made of conductive paste to electrically connect the exposed part 131*b* with the terminal electrode 136.

Each connection part 138 may be formed by spreading the conductive paste, and may include binder resin and a material having excellent conductivity and low resistance, such as Ag, Al, or Cu.

Blocking partition walls 125 are formed between the connection parts 138 and on the dielectric layer 170.

One end 125*a* of the blocking partition wall 125 is located between the common electrodes 131, and the other end 125*b* is located between the terminal electrodes 136.

The height $h_1$ of the blocking partition walls 125 is less than the height $h_2$ of the barrier ribs 120 but greater than the height $h_3$ of the common electrodes 131 measured from the surface of the dielectric layer 170. However, the height $h_1$ of the blocking partition walls 125 may equal the height $h_2$ of the barrier ribs 120. In other words, $h_2 \geqq h_1 > h_3$.

As shown in FIG. 1, an image display area $A_1$ is formed by the discharge cells 160, and a dummy area $A_2$, in which an image is not displayed, is formed at the edge of the pair of substrates 110. The PDP 100 is designed so that the blocking partition walls 125 are located in the dummy area $A_2$ so that they do not influence discharge.

The blocking partition walls 125 electrically insulate neighboring connection parts 138 by blocking the movement of the conductive paste of the connection parts 138, which may occur when spreading the conductive paste to form the connection parts 138.

A manufacturer may form a connection pattern of terminal parts of electrodes by a dispensing method in a pattern forming process. As shown in FIG. 1, after arranging the blocking partition walls 125 between neighboring common electrodes 131, the connection pattern of terminal parts of electrodes, which includes the connection parts 138, may be formed by injecting conductive paste to cover each exposed part 131*b* and a portion of each terminal electrode 136 using air pressure. Here, the blocking partition walls 125 may prevent short circuits in the connection structure of terminal parts of electrodes by preventing the conductive paste from moving between neighboring connection parts 138.

The signal transmitting members 150 are electrically connected with the terminal electrodes 136.

The signal transmitting members 150 may be a flexible printed cable (FPC) or a tape carrier package (TCP), and in this case, the signal transmitting members 150 are installed in a one-to-one correspondence to individual conductive lines of the FPC or TCP.

Here, the connections between the conductive lines of the signal transmitting members 150 and the terminal electrodes 136 may be achieved using an anisotropic conductive film (ACF).

Since the structure of the common electrodes 131 is symmetrical to the structure of the scan electrodes 132, the connection structure of terminal parts of the scan electrodes 132 may be the same as the connection structure of terminal parts of the common electrodes 131 in relation to the blocking partition walls 125 and the connection parts 138.

That is, though not shown in FIG. 1 and FIG. 2, the structure of the barrier ribs 120, the blocking partition walls 125, exposed parts of the scan electrodes 132, the terminal electrodes 136, the connection parts 138, and the signal transmitting members 150 may be formed symmetrically on the opposite edge of the PDP 100.

While the terminal electrodes 136 are shown formed on the dielectric layer 170, they may have other locations.

That is, in some cases, the dielectric layer 170 may not be included. In particular, if the discharge parts of the common electrodes 131 and scan electrodes 132 are shaped to surround the discharge cells 160 as described above, separate address electrodes 140 are unnecessary when the discharge parts of the common electrodes 131 and the discharge parts of the scan electrodes 132 are crossed. In this case, the dielectric layer 170 is also unnecessary.

The operation of the PDP 100 having the structure for connecting terminal parts of electrodes will now be described.

The barrier ribs 120, the blocking partition walls 125, the sustain electrode pairs 130, the terminal electrodes 136, and the connection parts 138 of the PDP 100 are configured according to the first embodiment described above. The individual conductive lines forming the signal transmitting members 150 are respectively electrically connected with the terminal electrodes 136.

After assembling the PDP 100 and adding discharge gas, address discharge occurs when applying an address voltage between the address electrodes 140 and the scan electrodes 132 from an outside power source, thereby selecting discharge cells 160 in which sustain discharge will occur.

If a discharge sustain voltage is applied between the common electrodes 131 and the scan electrodes 132 of the selected discharge cells 160 via the signal transmitting members 150, sustain discharge occurs due to a movement of wall charges accumulated on the common electrodes 131 and the scan electrodes 132, and the energy level of the discharge gas drops during the sustain discharge, thereby emitting ultraviolet rays.

The ultraviolet rays excite the phosphor layers 180 of the discharge cells 160, and when the energy levels of the excited phosphor layers 180 drop, visible rays are emitted and projected through the first substrate 111 to form an image.

In the structure for connecting terminal parts of electrodes according to the first exemplary embodiment described above, the blocking partition walls 125 allow the discharge electrodes, such as the common electrodes 131 and the scan electrodes 132, to be quickly connected to the terminal electrodes 136 by installing the connection parts 138 made of conductive paste using the dispensing method. The electrical insulation between neighboring terminal electrodes 136 may be reliably maintained, thereby preventing circuit faults of the terminal electrodes 136.

A second exemplary embodiment of the present invention will now be described below with reference to FIG. 4, FIG. 5, and FIG. 6.

Figure 4:
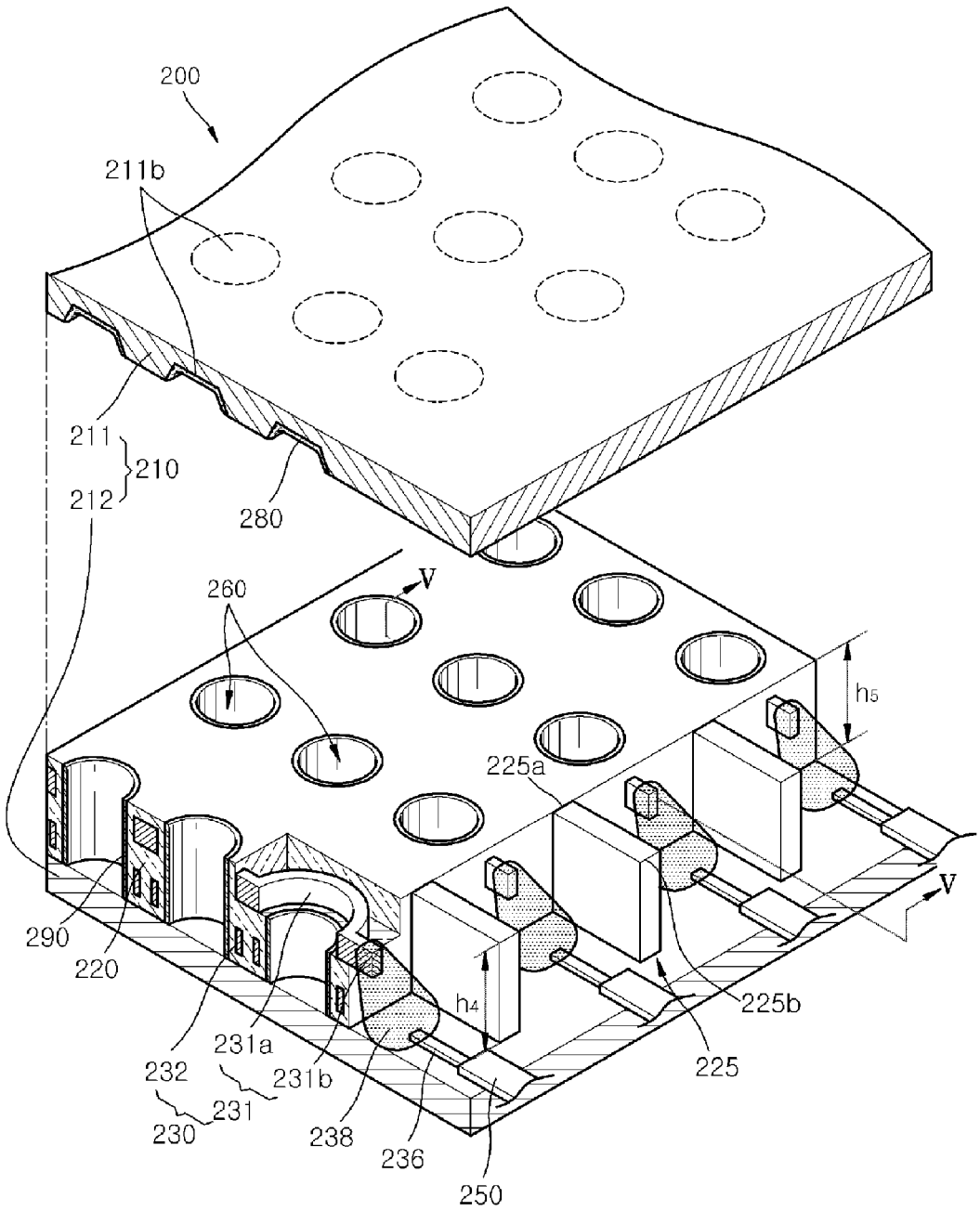
FIG. 4 is an exploded perspective view of part of a PDP including a structure for connecting terminal parts of electrodes according to a second exemplary embodiment of the present invention.
Figure 5:
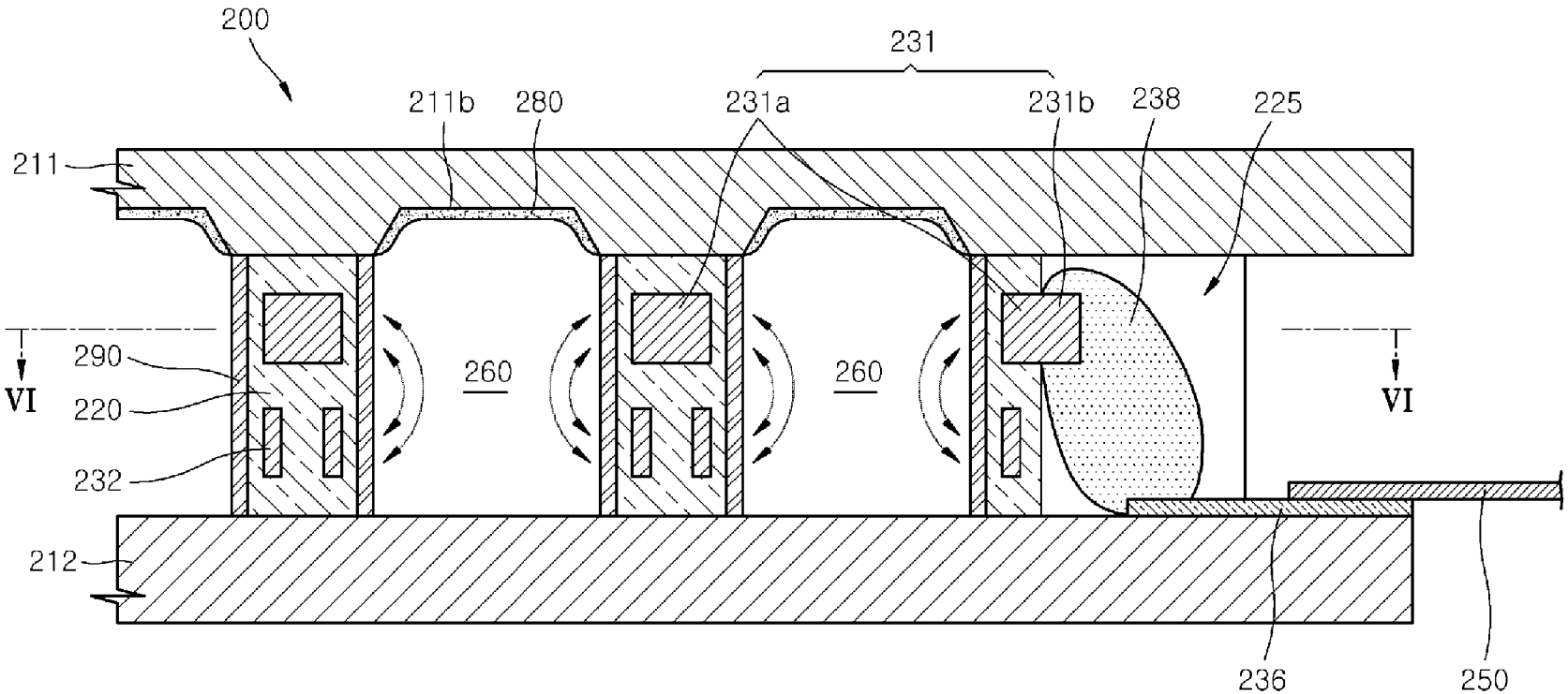
FIG. 5 is a cross-sectional view through section V-V of FIG. 4.
Figure 6:
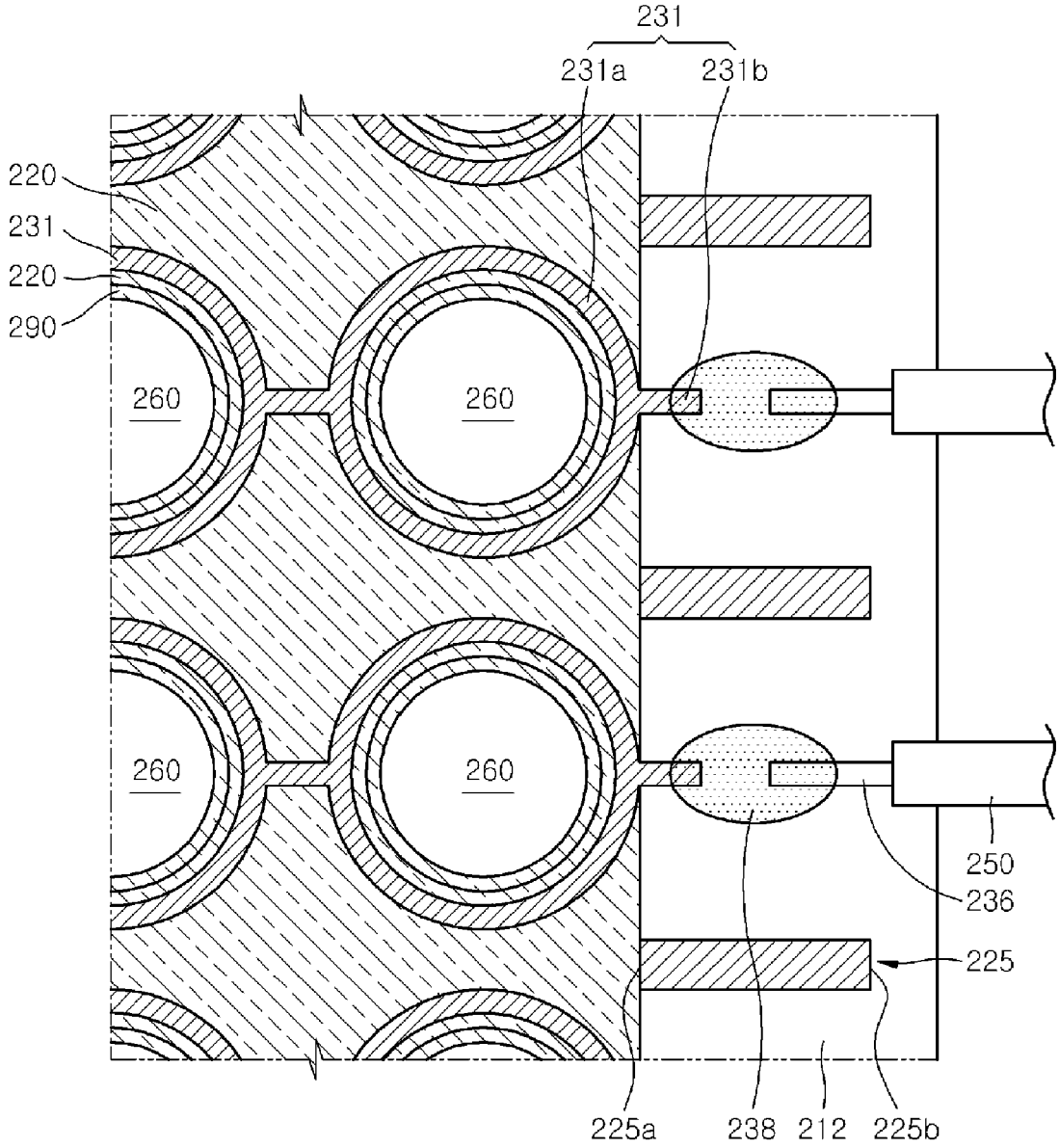
FIG. 6 is a cross-sectional view through section VI-VI of FIG. 5.

FIG. 4 is an exploded perspective view of part of a PDP 200 including a structure for connecting terminal parts of electrodes according to the second exemplary embodiment of the present invention, FIG. 5 is a cross-sectional view through section V-V of FIG. 4, and FIG. 6 is a cross-sectional view through section VI-VI of FIG. 5.

As shown in FIG. 4, FIG. 5, and FIG. 6, the PDP 200 includes a pair of substrates 210, barrier ribs 220, sustain electrode pairs 230, and signal transmitting members 250.

The pair of substrates 210 includes a first substrate 211 and a second substrate 212 facing each other and separated by a predetermined gap. The first substrate 211 may be made of a transparent material such as glass to allow visible rays to pass through it.

While the pair of substrates 210 does not include a substrate protection layer, the substrate protection layer may be included on a substrate. In this case, the substrate protection layer prevents the substrate facing discharge spaces from being damaged by plasma particle sputtering, lowers a discharge voltage by emitting secondary electrons, and may be made of MgO.

The barrier ribs 220 are made of a dielectric substance and define a plurality of discharge cells 260 together with the first substrate 211 and the second substrate 212.

Since the horizontal section of each discharge cell 260 is circular, cylindrical discharge spaces are formed.

Since the first substrate 211 and the second substrate 212 are longer than the barrier ribs 220, they may sufficiently define the discharge cells 260 together with the barrier ribs 220 and still allow the signal transmitting members 250 to be easily located in areas between them without the barrier ribs 220.

While the horizontal section of each discharge cell 260 is shown with a circular shape, the horizontal section of each discharge cell 260 may have various shapes such as a polygon, a triangle, a square, a pentagon, and an oval.

The barrier ribs 220 are formed as extensions of the second substrate 212.

Alternatively, the barrier ribs 220 may be formed by inserting the sustain electrode pairs 230 in a dielectric substance, forming the dielectric substance into a sheet, forming holes corresponding to the discharge spaces 260 in the sheet, and placing the sheet between the pair of substrates 210.

The dielectric substance of the barrier ribs 220 may prevent charged particles from colliding with and damaging the sustain electrode pairs 230, and it may accumulate wall charges by inducing charged particles. PbO, $B_2O_3$, or $SiO_2$ may be used for the dielectric substance.

Each sustain electrode pair 230 includes a common electrode 231 and a scan electrode 232 as discharge electrodes.

The common electrodes 231 and the scan electrodes 232 surround the discharge cells 260 and have a continuous ring shape whose outer and inner circumferences are circular.

Alternatively, the common electrodes 231 and the scan electrodes 232 surrounding the discharge spaces may be formed in other shapes such as a ladder shape, a rectangular loop shape, and a ring shape whose outer and inner circumferences are oval.

Since the sustain electrode pairs 230, which are discharge electrodes, are located inside the barrier ribs 220, the common electrodes 231 and the scan electrodes 232 of the sustain electrode pairs 230 do not have to be transparent. Rather, they may be formed of a metallic material having excellent conductivity and low resistance, such as Ag, Al, or Cu. This increases discharge response speed, prevents signal distortion, and reduces power consumption.

The scan electrodes 232 are separate from the common electrodes 231, and they are formed to cross the common electrodes 231.

Since the scan electrodes 232 cross the common electrodes 231 and perform addressing in the second embodiment, the second embodiment differs from the first embodiment in that address electrodes are not included.

While the second embodiment does not require separate address electrodes because the scan electrodes 232 cross the common electrodes 231 and perform addressing, address electrodes could be included in alternative embodiments. Specifically, the common electrodes 231 and scan electrodes 232 may be arranged extending in the same direction inside the barrier ribs 220. In this case, address electrodes surrounding the discharge cells 260 may be added, or address electrodes may be formed in stripe pattern inside a dielectric layer formed on a substrate, as in the first embodiment.

Barrier rib protection layers 290, which may be made of a material such as MgO, are formed on the sides of the barrier ribs 220 to protect the barrier ribs 220, the common electrodes 231, and the scan electrodes 232 from damage by plasma particle sputtering and to lower the discharge voltage by emitting secondary electrons.

Phosphor layers 280 are arranged on etching parts **211*b* formed on the first substrate 211. The etching parts 211*b* are located at the upper surface of the discharge cells 260**.

While the phosphor layers 280 are shown arranged on the etching parts **211*b*, they may occupy various positions in the discharge cells 260**.

The phosphor layers 280 generate visible rays after receiving ultraviolet rays. A red phosphor layer formed in a red light emission discharge cell may include a fluorescent substance such as $Y(V,P)O_4$:Eu; a green phosphor layer formed in a green light emission discharge cell may include a fluorescent substance such as $Zn2SiO_4$:Mn; and a blue phosphor layer formed in a blue light emission discharge cell may include a fluorescent substance such as BAM:Eu.

Discharge gas, such as Ne, Xe, or Ne/Xe-mixed gas, is sealed in the discharge cells 260 defined by the first substrate 211, the second substrate 212, and the barrier ribs 220.

As described above, each sustain electrode pair 230, which are discharge electrodes, includes the common electrode 231 and the scan electrode 232. Since the common electrode 231 and the scan electrode 232 may be symmetrically formed to be easily connected to driving circuit boards (not shown) using the corresponding signal transmitting member 250, and they share the same structure, a structure for connecting terminal parts of electrodes will now be described using the common electrode 231 as an example.

Each common electrode 231 includes a discharge part **231*a* and an exposed part 231*b***.

The discharge part **231*a* is located inside the barrier rib 220 to perform discharge, and the exposed part 231*b* is located at the end of the discharge part 231*a*, outside the barrier rib 220**.

Each terminal electrode 236 is formed on the second substrate 212, and each connection part 238 is made of conductive paste to electrically connect the exposed part 231*b* with the terminal electrode 236.

Each connection part 238 may be formed by spreading the conductive paste, and may include binder resin and a material having excellent conductivity and low resistance, such as Ag, Al, or Cu.

Blocking partition walls 225 are formed between the connection parts 238 and on the second substrate 212.

One end 225*a* of the blocking partition wall 225 is attached to the barrier ribs 220, and the other end 225*b* is located between the terminal electrodes 236.

The height $h_4$ of the blocking partition walls 225 is equal to the height $h_5$ of the barrier ribs 220.

The blocking partition walls 225 electrically insulate neighboring connection parts 238 by blocking the movement of the conductive paste of the connection parts 238, which may occur when spreading the conductive paste to form the connection parts 238.

A manufacturer may form a connection pattern of terminal parts of electrodes by the dispensing method in a pattern forming process. As shown in FIG. 4, after arranging the blocking partition walls 225 between the exposed parts 231*b* of neighboring common electrodes 231, the connection structure of terminal parts of electrodes, which includes the connection parts 238, may be formed by injecting conductive paste to cover each exposed part 231*b* and a portion of each terminal electrode 236 using air pressure. Here, the blocking partition walls 225 may prevent short circuits in the connection structure of terminal parts of electrodes by preventing the conductive paste from moving between neighboring connection parts 238.

The signal transmitting members 250 are electrically connected with the terminal electrodes 236.

The signal transmitting members 250 may be an FPC or a TCP, and in this case, the signal transmitting members 250 are installed in a one-to-one correspondence to individual conductive lines of the FPC or TCP.

Here, the connections between the conductive lines of the signal transmitting members 250 and the terminal electrodes 236 may be achieved using an ACF.

Since the structure of the common electrodes 231 is symmetrical to the structure of the scan electrodes 232, the connection structure of terminal parts of the scan electrodes 232 may be the same as the connection structure of terminal parts of the common electrodes 231 in relation to the blocking partition walls 225 and the connection parts 238.

That is, though not shown in FIG. 4, the structure of the barrier ribs 220, the blocking partition walls 225, the exposed parts of the scan electrodes 232, the terminal electrodes 236, the connection parts 238, and the signal transmitting members 250 may be formed symmetrically on the appropriate edge of the PDP 200.

Address electrodes are not included in the PDP 200, but if address electrodes are additionally located inside the barrier ribs 220, the dispensing method may be effectively used in a process of forming a structure for connecting terminal parts of the address electrodes.

The operation of the PDP 200 having the structure for connecting terminal parts of electrodes will now be described.

The barrier ribs 220, the blocking partition walls 225, the sustain electrode pairs 230, the terminal electrodes 236, and the connection parts 238 of the PDP 200 are configured according to the second embodiment described above. The individual conductive lines forming the signal transmitting members 250 are respectively electrically connected with the terminal electrodes 236.

After assembling the PDP 200 and adding discharge gas, address discharge occurs when applying an address voltage between the common electrodes 231 and the scan electrodes 232 from an outside power source, thereby selecting discharge cells 260 in which sustain discharge will occur.

If a discharge sustain voltage is applied between the common electrodes 231 and the scan electrodes 232 of the selected discharge cells 260 via the signal transmitting members 250, sustain discharge occurs due to a movement of wall charges accumulated on the common electrodes 231 and the scan electrodes 232, and the energy level of the discharge gas drops during the sustain discharge, thereby emitting ultraviolet rays.

The ultraviolet rays excite the phosphor layers 280 of the discharge cells 260, and when the energy levels of the excited phosphor layers 280 drop, visible rays are emitted and projected through the first substrate 211 to form an image.

In the structure for connecting terminal parts of electrodes according to the second exemplary embodiment described above, the blocking partition walls 225 allow the discharge electrodes, such as the common electrodes 231 and the scan electrodes 232, to be quickly connected to the terminal electrodes 236 by installing the connection parts 238 made of conductive paste using the dispensing method. The electrical insulation between neighboring terminal electrodes 236 may be reliably maintained, thereby preventing circuit faults of the terminal electrodes 236.

As described above, in a PDP having a structure for connecting terminal parts of electrodes according to exemplary embodiments of the present invention, discharge electrodes and terminal electrodes may be reliably and efficiently connected to each other using connection parts made of conductive paste and blocking partition walls.

Since the structure for connecting terminal parts of electrodes may be quickly and reliably formed using the dispensing method in a process of forming a pattern of the electrodes, manufacturing time and cost may be reduced.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A structure for connecting terminal parts of electrodes of a plasma display panel (PDP), the structure comprising:

a pair of substrates facing each other;

barrier ribs arranged between the pair of substrates and defining discharge cells together with the pair of substrates;

a dielectric layer arranged between the pair of substrates;

discharge electrodes, each discharge electrode comprising a discharge part arranged inside the barrier ribs and an exposed part connected to the discharge part and arranged outside the barrier ribs;

terminal electrodes arranged on the dielectric layer;

connection parts comprising conductive paste electrically connecting the exposed parts with the terminal electrodes;

blocking partition walls electrically insulating neighboring connection parts from each other; and signal transmitting members electrically connected with the terminal electrodes.

2. The structure of claim 1, wherein each substrate is longer than the barrier ribs.

3. The structure of claim 1, wherein at least a portion of a surface of at least one substrate of the pair of substrates comprises a substrate protection layer.

4. The structure of claim 1, wherein at least a portion of a side of the barrier ribs is covered with a barrier rib protection layer.

5. The structure of claim 1, wherein the barrier ribs comprise a first barrier rib and a second barrier rib attached to the first barrier rib.

6. The structure of claim 5, wherein the discharge parts are arranged inside the first barrier rib.

7. The structure of claim 1, wherein the discharge parts surround at least a portion of the discharge cells.

8. The structure of claim 1, wherein the discharge electrode is a common electrode.

9. The structure of claim 1, wherein the discharge electrode is a scan electrode.

10. The structure of claim 1, wherein the discharge electrode is an address electrode.

11. The structure of claim 1, wherein the signal transmitting member is a flexible printed cable.

12. The structure of claim 1, wherein the signal transmitting member is a tape carrier package.

13. The structure of claim 1, wherein the electrical connection between the signal transmitting members and the terminal electrodes is achieved using an anisotropic conductive film.

14. The structure of claim 1, wherein a first end of the blocking partition wall is arranged between adjacent discharge electrodes, and a second end of the blocking partition wall is arranged between adjacent terminal electrodes.

15. The structure of claim 1, wherein the height of the blocking partition wall is less than the height of the barrier ribs, and the height of the blocking partition wall is greater than the height of each discharge electrode, the height of a discharge electrode being measured from the surface of the dielectric layer to the discharge electrode.

16. The structure of claim 1, wherein the height of the blocking partition wall is equal to the height of the barrier rib.

17. The structure of claim 1, wherein the blocking partition walls are arranged in an area in which an image is not displayed.

18. A plasma display panel comprising the structure for connecting terminal parts of electrodes of claim 1.

19. A structure for connecting terminal parts of electrodes of a plasma display panel (PDP), the structure comprising:

a pair of substrates facing each other;

barrier ribs arranged between the pair of substrates and defining discharge cells together with the pair of substrates;

discharge electrodes, each discharge electrode comprising a discharge part arranged inside the barrier ribs and an exposed part arranged outside the barrier ribs;

terminal electrodes arranged on one substrate of the pair of substrates;

connection parts comprising conductive paste electrically connecting the exposed parts with the terminal electrodes;

blocking partition walls electrically insulating neighboring connection parts from each other; and signal transmitting members electrically connected with the terminal electrodes.

20. The structure of claim 19, wherein each substrate is longer than the barrier ribs.

21. The structure of claim 19, wherein at least a portion of a surface of at least one substrate of the pair of substrates comprises a substrate protection layer.

22. The structure of claim 19, wherein at least a portion of a side of the barrier ribs is covered with a barrier rib protection layer.

23. The structure of claim 19, wherein the barrier ribs comprise a first barrier rib and a second barrier rib attached to the first barrier rib.

24. The structure of claim 23, wherein the discharge parts are arranged inside the first barrier rib.

25. The structure of claim 19, wherein the discharge parts surround at least a portion of the discharge cells.

26. The structure of claim 19, wherein the discharge electrode is a common electrode.

27. The structure of claim 19, wherein the discharge electrode is a scan electrode.

28. The structure of claim 19, wherein the discharge electrode is an address electrode.

29. The structure of claim 19, wherein the signal transmitting member is a flexible printed cable.

30. The structure of claim 19, wherein the signal transmitting member is a tape carrier package.

31. The structure of claim 19, wherein the electrical connection between the signal transmitting members and the terminal electrodes is achieved using an anisotropic conductive film.

32. The structure of claim 19, wherein a first end of the blocking partition wall is arranged between adjacent discharge electrodes, and a second end of the blocking partition wall is arranged between adjacent terminal electrodes.

33. The structure of claim 19, wherein the height of the blocking partition wall is less than the height of the barrier ribs, and the height of the blocking partition wall is greater than the height of each discharge electrode, the height of a discharge electrode being measured from the surface of the substrate on which the terminal electrodes are arranged to the discharge electrode.

34. The structure of claim 19, wherein the height of each blocking partition wall is equal to the height of the barrier rib.

35. The structure of claim 19, wherein the blocking partition walls are arranged in an area in which an image is not displayed.

36. A plasma display panel comprising the structure for connecting terminal parts of electrodes of claim 19.

* * * * *